US007155785B2

(12) United States Patent
Muromachi

(10) Patent No.: US 7,155,785 B2
(45) Date of Patent: Jan. 2, 2007

(54) BUCKLE DEVICE AND METHOD FOR ASSEMBLING THE SAME

(75) Inventor: Tetsushi Muromachi, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/258,014

(22) Filed: Oct. 26, 2005

(65) Prior Publication Data

US 2006/0090313 A1 May 4, 2006

(30) Foreign Application Priority Data

Nov. 1, 2004 (JP) ..... 2004-317721

(51) Int. Cl.
*A44B 11/26* (2006.01)

(52) U.S. Cl. ..... 24/641; 24/642; 24/633; 24/636

(58) Field of Classification Search ..... 24/633, 24/636, 641, 642, 643
See application file for complete search history.

(56) References Cited

U.S. PATENT DOCUMENTS 4,454,634 A * 6/1984 Haglund et al. ..... 24/636
4,642,858 A * 2/1987 Ishiguro et al. ..... 24/641
5,054,171 A * 10/1991 Tanaka ..... 24/637
6,438,810 B1 * 8/2002 Rogers et al. ..... 24/641
6,463,639 B1 * 10/2002 Mori ..... 24/633
6,701,587 B1 * 3/2004 Sato et al. ..... 24/633
6,746,048 B1 * 6/2004 Tajima et al. ..... 280/801.1

FOREIGN PATENT DOCUMENTS

JP 05-278564 10/1993

* cited by examiner

*Primary Examiner*—Robert J. Sandy
*Assistant Examiner*—Marcus Menezes
(74) *Attorney, Agent, or Firm*—Roberts Mlotkowski & Hobbes; Thomas W. Cole

(57) ABSTRACT

A buckle device includes a buckle body that includes a bottom plate and a pair of side walls with a tongue plate being inserted and retained between the side walls, and a release button that includes an operation portion that is push-operated along the insertion direction to release the retention of the tongue plate. Elongated holes along the insertion direction of the tongue plate are formed in the pair of side walls of the buckle body. The release button also includes a pair of arm portions that extend in the insertion direction from both width-direction ends of the operation portion, a pair of extension portions that have a predetermined elasticity and extend from width-direction ends of the pair of arm portions toward the bottom plate, and pawl portions that protrude from ends of the pair of extension portions toward the side walls and movably fit into the elongated holes.

15 Claims, 5 Drawing Sheets

BUCKLE DEVICE AND METHOD FOR ASSEMBLING THE SAME

CROSS-REFERENCE TO RELATED APPLICATION

This application claims priority under 35 USC 119 from Japanese Patent Application No. 2004-317721, the disclosure of which is incorporated by reference herein.

BACKGROUND OF THE INVENTION

1. Field of the Invention

The present invention relates to a buckle device that configures a seat belt device in a vehicle and is for retaining a tongue plate attached to a webbing.

2. Description of the Related Art

There is a buckle device that includes a buckle body configuring a frame, a lock plate movable toward and away from a tongue plate inserted into the buckle body, and a release button attached, such that it is movable within a predetermined range, to the buckle body (e.g., see Japanese Patent Application Publication (JP-A) No. 5-278564).

In the buckle device disclosed in JP-A No. 5-278564, when the tongue plate is inserted into the buckle body (buckle base), the lock plate (latch) approaches and engages with the tongue plate, whereby the tongue plate is retained in the buckle body. When the release button (press button) is push-operated, the lock plate separates from the tongue plate and the retention is released.

In the buckle device with this configuration, the release button includes an operation portion that is push-operated by a passenger and a pair of arm portions that extend along the operation direction from both width-direction ends of the operation portion. Guide protrusions that protrude in directions in which they face each other are formed on the ends of the pair of arm portions. The guide protrusions movably fit into elongated holes formed in side walls of the buckle body, whereby the release button is attached to the buckle body.

However, in the buckle device with this configuration, there is the problem that assemblability is poor because when the release button is to be assembled with respect to the buckle body, the guide protrusions cannot be fitted into the elongated holes in the buckle base unless the pair of arm portions are greatly bent in the directions in which they separate from each other.

Also, in the buckle device with this configuration, when the push load is biasingly applied to one width-direction end (one arm portion) of the operation portion when the operation portion of the release button is push-operated, the one arm portion and the other arm portion are alternately displaced along the operation direction, and strain arises in the release button. If the strain in the release button is large, sometimes a sufficient operation stroke of the release button cannot be secured and the retention of the tongue plate cannot be reliably released. For this reason, in the buckle device with this configuration, it is necessary to preset the operation stroke of the release button to be long, which results in the size of the device becoming large.

SUMMARY OF THE INVENTION

In consideration of these circumstances, it is an object of the present invention to obtain a buckle device where the assemblability of the release button with respect to the buckle body is improved.

In consideration of these circumstances, it is another object of the invention to obtain a buckle device that can prevent or suppress deformation of the release button.

A first aspect of the invention provides a buckle device comprising: a buckle body that includes a bottom plate formed in a long plate-like shape and a pair of side walls extending from both width-direction ends of the bottom plate, with a tongue plate being inserted and retained between the pair of side walls from one longitudinal-direction end of the bottom plate, and with elongated holes along an insertion direction of the tongue plate being formed in the pair of side walls; and a release button that includes an operation portion that is disposed on the one longitudinal-direction end of the buckle body such that it is movable along the insertion direction of the tongue plate and which is push-operated along the insertion direction, and a pair of arm portions that extend from both width-direction ends of the operation portion in the insertion direction, wherein the operation portion is push-operated to release the retention of the tongue plate, and wherein the release button further includes a pair of extension portions that have a predetermined elasticity and extend from respective width-direction ends of the pair of arm portions toward the bottom plate, and pawl portions that protrude from respective ends of the pair of extension portions toward each of the side walls and movably fit into the elongated holes.

In the buckle device of the first aspect, the buckle body is formed such that its cross section is substantially U-shaped including the bottom plate and the pair of side walls. The tongue plate is inserted and retained between the pair of side walls from the one longitudinal-direction end of the bottom plate. The release button is disposed on the one longitudinal-direction end (the side where the tongue plate is inserted) of the buckle body. The release button includes the operation portion and the pair of arm portions that extend along the insertion direction of the tongue plate from both width-direction ends of the operation portion. When the operation portion is push-operated along the insertion direction of the tongue plate, the retention of the tongue plate is released.

Here, the release button includes the pair of extension portions that extend from the width-direction ends of the pair of arm portions toward the bottom plate of the buckle body. The pawl portions are formed such that they protrude from the ends of the pair of extension portions toward the side walls of the buckle body. The pawl portions movably fit into the elongated holes formed in the pair of side walls of the buckle body. Thus, the release button is retained in the buckle body and the operation direction of the release button is guided.

Moreover, the pair of extension portions have a predetermined elasticity. Thus, when the release button is to be assembled with respect to the buckle body, the pawl portions can be fitted into the elongated holes in the buckle body by bending the pair of extension portions and without having to greatly bend the pair of arm portions in the direction in which they separate from each other as in the conventional buckle device. Thus, the release button can be easily assembled with respect to the buckle body.

In this manner, in the buckle device of the first aspect, the assemblability of the release button with respect to the buckle body is improved.

In the buckle device of the first aspect, the pawl portions may be formed in thin wedge shapes toward the bottom plate.

In the buckle device according to this aspect, the pawl portions are formed in thin wedge shapes toward the bottom plate of the buckle body. Namely, the extension portions and the pawl portions are configured in a so-called "snap-fit" manner, so that when the release button is to be assembled with respect to the buckle body, the release button is pushed toward the bottom plate from the side of the pair of side walls opposite from the bottom plate, whereby a component force in the direction in which the extension portions flex and deform arises in the extension portions due to the sliding contact between the wedge pawl portions and the side walls of the buckle body. Thus, the release button can be more easily assembled with respect to the buckle body.

In this manner, in the buckle device according to this configuration, the assemblability of the release button with respect to the buckle body is further improved.

A second aspect of the invention provides a buckle device comprising a release button including an operation portion that is push-operated and a pair of arm portions that extend along an operation direction from both width-direction ends of the operation portion, with the operation portion being push-operated to release the retention of a tongue plate, wherein the release button includes a coupler portion that spans the distance between, and couples together, ends of the pair of arm portions.

In the buckle device of the second aspect, the pair of arm portions extend along the operation direction of the operation portion from both width-direction ends of the operation portion of the release button. The ends of the pair of arm portions are coupled together by the coupler portion that spans the distance between them, and the rigidity of the release button is improved by the coupler portion. For this reason, even if the push load is biasingly applied to one width-direction end (one of the arm portions) of the operation portion, deformation of the release button is prevented or suppressed (the alternate deformation of the pair of arm portions along the operation direction is prevented or suppressed).

In this manner, in the buckle device of the second aspect, deformation of the release button can be prevented or suppressed.

A third aspect of the invention provides a buckle device comprising: a buckle body that includes a bottom plate formed in a long plate-like shape and a pair of side walls extending from both width-direction ends of the bottom plate, with a tongue plate being inserted and retained between the pair of side walls from one longitudinal-direction end of the bottom plate, and with elongated holes along the insertion direction of the tongue plate being formed in the pair of side walls; and a release button that includes an operation portion that is disposed on the one longitudinal-direction end of the buckle body such that it is movable along the insertion direction of the tongue plate and which is push-operated along the insertion direction, and a pair of arm portions that extend from both width-direction ends of the operation portion in the insertion direction, wherein the operation portion is push-operated to release the retention of the tongue plate, and wherein the release button further includes a pair of extension portions that have a predetermined elasticity and extend from respective width-direction ends of the pair of arm portions toward the bottom plate, pawl portions that protrude from respective ends of the pair of extension portions toward each of the side walls and movably fit into the elongated holes, and a coupler portion that spans the distance between, and couples together, the ends of the pair of arm portions.

The buckle device of the third aspect has basically the same configuration as that of the buckle device of the first aspect, and the release button includes the pair of extension portions and the pawl portions protrudingly formed on the ends of the pair of extension portions. Thus, similar to the buckle device of the first aspect, the assemblability of the release button with respect to the buckle body is improved.

Moreover, in a buckle device of a third aspect, the release button includes a coupler portion that couples together the ends of the pair of arm portions. Thus, deformation of the release button can be prevented or suppressed.

In this manner, in the buckle device of the third aspect, the assemblability of the release button with respect to the buckle body is improved, and deformation of the release button can be prevented or suppressed.

As described above, the present invention has the following effects.

In the buckle device of the first aspect, the assemblability of the release button with respect to the buckle body is improved.

In the buckle device of the first aspect, the pawl portions may be formed in thin wedge shapes toward the bottom plate. According to this configuration, the assemblability of the release button with respect to the buckle body is further improved.

In the buckle device of the second aspect, deformation of the release button can be prevented or suppressed.

In the buckle device of the third aspect, the assemblability of the release button with respect to the buckle body is improved, and deformation of the release button can be prevented or suppressed.

DETAILED DESCRIPTION OF THE INVENTION

Figure 4:
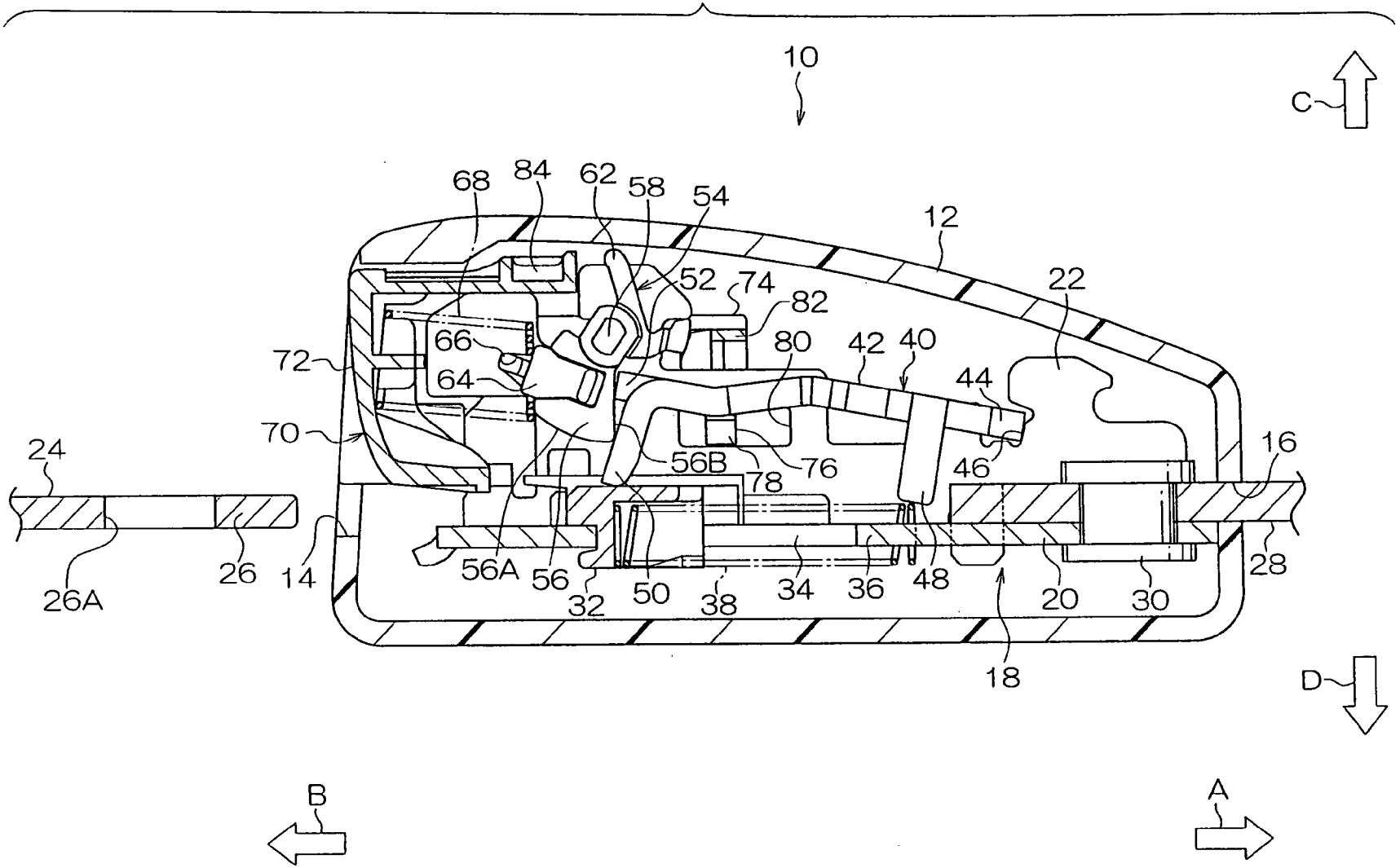
FIG. 4 is a cross-sectional view showing the overall configuration of the buckle device pertaining to the embodiment of the invention.
Figure 5:
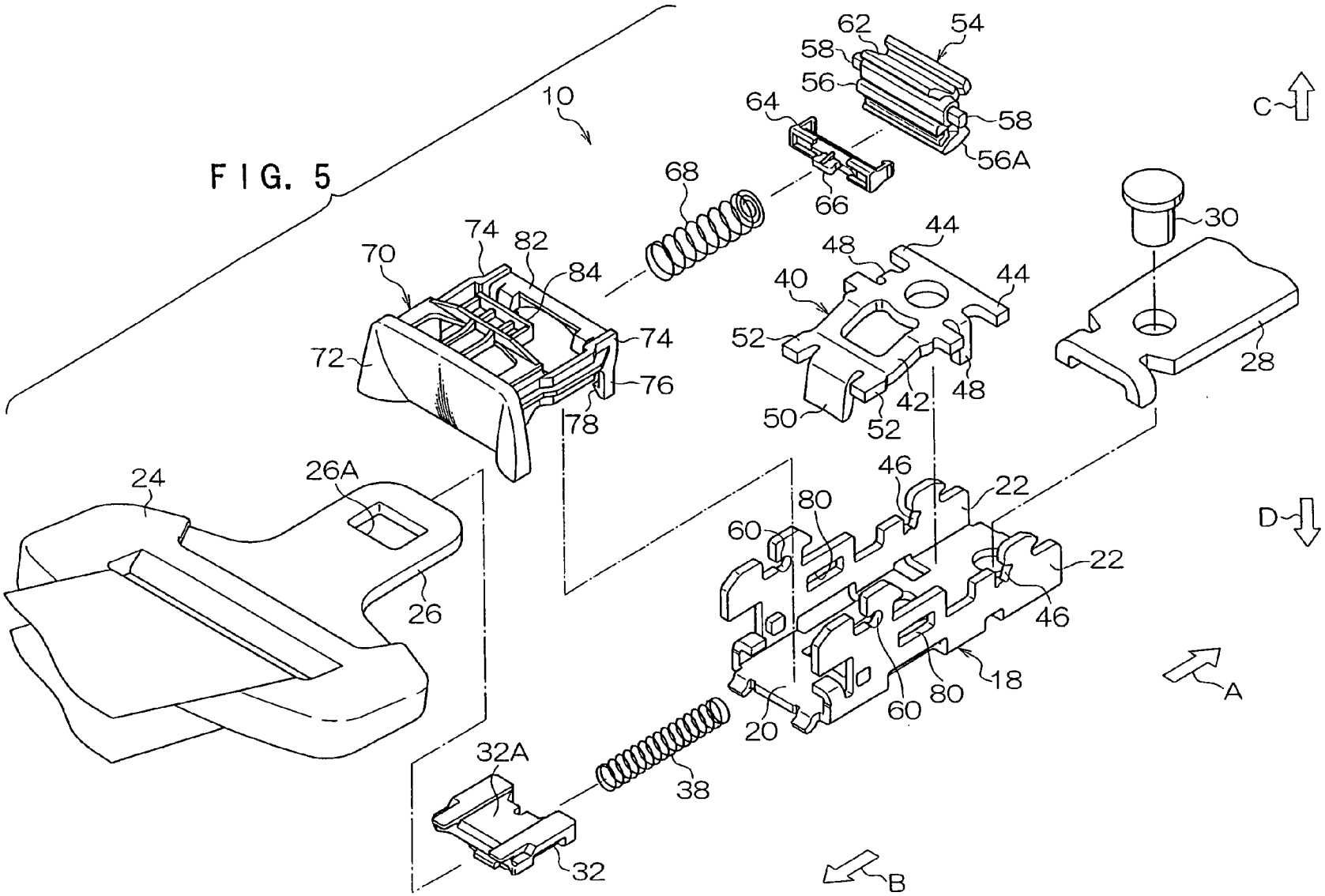
FIG. 5 is an exploded perspective view showing the overall configuration of the buckle device pertaining to the embodiment of the invention.

The configuration of a buckle device 10 pertaining to an embodiment of the invention is shown in an exploded perspective view in FIG. 5. The configuration of the buckle device 10 is also shown in a cross-sectional view in FIG. 4.

As shown in FIG. 4, the buckle device 10 includes a case 12. The case 12 is formed in a box-like cylindrical shape where both longitudinal-direction ends are open. The opening in one longitudinal-direction end serves as a tongue insertion opening 14, and the opening in the other longitudinal-direction end serves as an anchor insertion opening 16. A buckle body 18 is housed inside the case 12.

The buckle body 18 includes a bottom plate 20, which is formed in a long tabular shape along the longitudinal direction of the case 12, and a pair of side walls 22, which integrally extend from both width-direction ends of the bottom plate 20 toward one side of the bottom plate 20 in the plate thickness direction (in the direction of arrow C). Overall, the buckle body 18 is formed such that its cross section is substantially U-shaped. In the buckle body 18, an insertion plate portion 26 of a tongue plate 24 inserted from the tongue insertion opening 14 in the case 12 is inserted between the pair of side walls 22 from one longitudinal-direction end (in the direction of arrow B) of the bottom plate 20.

The end portion of an anchor plate 28 inserted from the anchor insertion opening 16 in the case 12 is overlapped with the other longitudinal-direction end (in the direction of arrow A) of the bottom plate 20. The bottom plate 20 and the anchor plate 28 are coupled and fixed together by a rivet 30 that penetrates the bottom plate 20 and the anchor plate 28. The base end of the anchor plate 28 is fixed to a vehicle body at the side of a seat in a vehicle (neither the vehicle body nor the seat is shown). Thus, the buckle device 10 is attached to the vehicle.

An ejector 32 is disposed between the pair of side walls 22. Part of the ejector 32 engages with a substantially rectangular through hole 34 formed in the bottom plate 20. The through hole 34 is formed in a long shape along the longitudinal direction of the bottom plate 20, and the ejector 32 is slidable within a predetermined range in the longitudinal direction of the bottom plate 20 along the through hole 34.

An engagement protrusion 36 is protrudingly formed on the inner peripheral portion of one longitudinal-direction end (in the direction of arrow A) of the through hole 34, and one end of an ejector spring 38 that is a compression coil spring is latched to the engagement protrusion 36. The other end of the ejector spring 38 is latched to the ejector 32. The ejector 32 is urged by the urging force of the ejector spring 38 toward one longitudinal-direction end (in the direction of arrow B) of the bottom plate 20.

Figure 3:
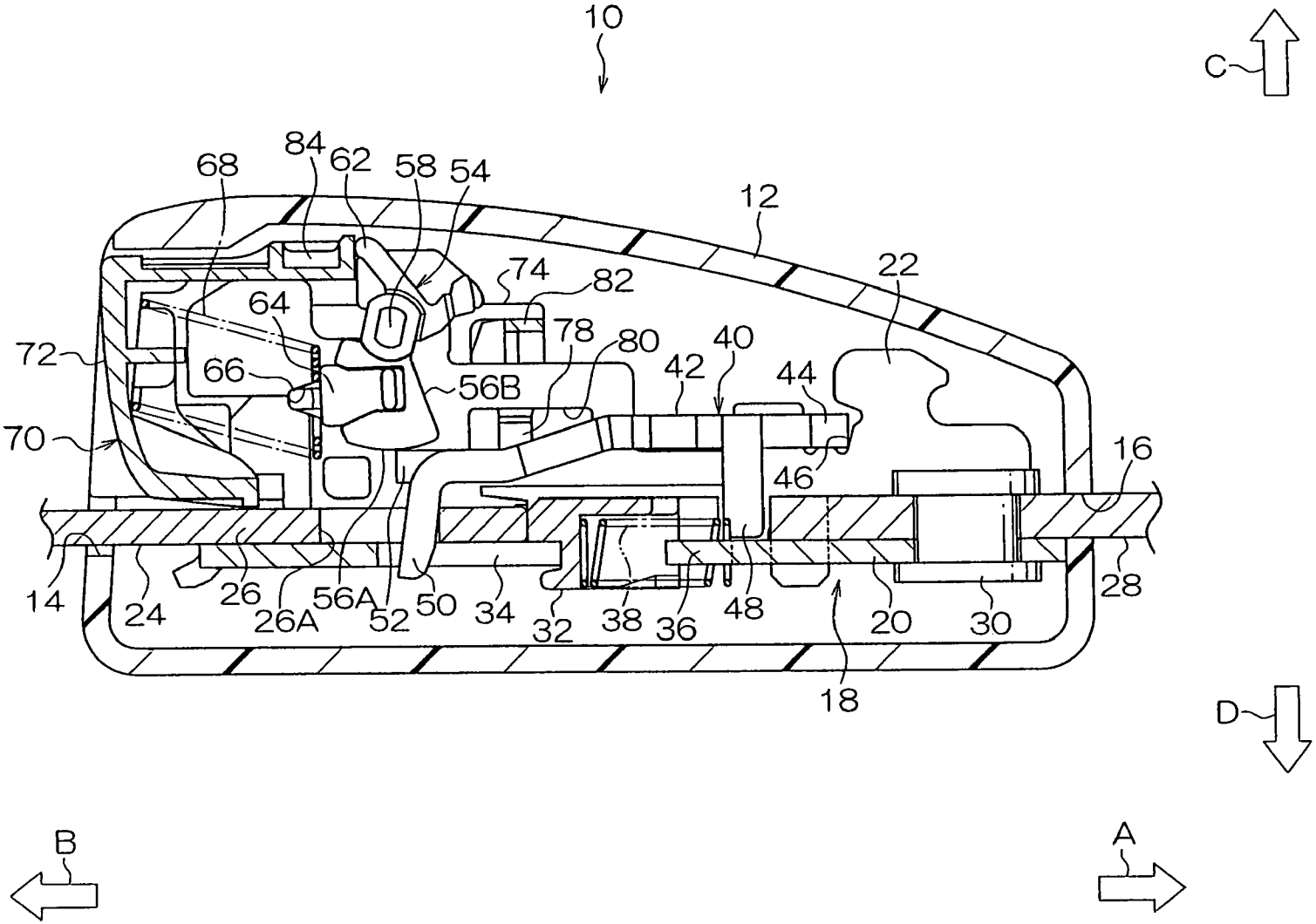
FIG. 3 is a cross-sectional view showing the overall configuration of the buckle device pertaining to the embodiment of the invention.

The ejector 32 is pushed by the insertion plate portion 26 of the tongue plate 24 inserted between the pair of side walls 22, whereby the ejector 32 is slid toward the other longitudinal-direction end of the bottom plate 20 counter to the urging force of the ejector spring 38 (the state shown in FIG. 3).

The buckle device 10 also includes a lock plate 40. The lock plate 40 includes a body portion 42 formed in a long plate-like shape along the longitudinal direction of the bottom plate 20. A pair of support portions 44 that protrude outward toward both width-direction sides are formed on the base end (end portion in the direction of arrow A) of the body portion 42. The pair of support portions 44 enter support holes 46 formed in the side walls 22 of the buckle body 18, whereby the lock plate 40 is supported by the pair of side walls 22 such that it is pivotable a predetermined angle around the pair of support portions 44 (support holes 46).

A pair of arm portions 48 that extend from both width-direction ends of the body portion 42 toward the bottom plate 20 (the direction of arrow D) are disposed on the base end of the body portion 42. The pair of arm portions 48 are formed such that their ends are positioned on the sliding locus of the ejector 32. When the ejector 32 is slid toward the other longitudinal-direction end (in the direction of arrow A) of the bottom plate 20, the pair of arm portions 48 are pushed by the ejector 32 toward the other longitudinal-direction end of the bottom plate 20, and the body portion 42 (lock plate 40) pivots toward the bottom plate 20 (in the direction of arrow D).

An engagement tab 50 extends from the end of the body portion 42 (the end portion in the direction of arrow B) toward one side of the body portion 42 in the plate thickness direction (toward the bottom plate 20 in the direction of arrow D). The engagement tab 50 is formed such that its end (in the direction of arrow D) slightly slants toward one longitudinal-direction end of the bottom plate 20 (in the direction of arrow B). The end portion of the engagement tab 50 corresponds to the though hole 34 formed in the bottom plate 20. The lock plate 40 pivots toward the bottom plate 20, whereby the engagement tab 50 passes through the through hole 34 and an engagement hole 26A in the insertion plate portion 26 inserted between the pair of side walls 22, and regulates the removal of the tongue plate 24 (retains the tongue plate 24).

A placement portion 32A is formed on one thickness-direction surface (in the direction of arrow C) of the ejector 32 in correspondence to the engagement tab 50 of the lock plate 40. The placement portion 32A interferes with the end portion of the engagement tab 50 and regulates the pivoting of the lock plate 40 toward the bottom plate 20 in a state where the tongue plate 24 has not been inserted between the pair of side walls 22, i.e., a state where the ejector 32 is retained at the other longitudinal-direction end (in the direction of arrow B) of the through hole 34 by the urging force of the ejector spring 38.

A pair of abutment tabs 52 that extend from the end of the body portion 42 toward one longitudinal-direction end (in the direction of arrow B) of the bottom plate 20 are disposed at both width-direction sides of the engagement tab 50. The pair of abutment tabs 52 correspond to a lock member 54.

The lock member 54 is disposed opposite from the bottom plate 20 via the body portion 42 of the lock plate 40. The lock member 54 includes a substantially triangular column-shaped cam portion 56, whose longitudinal direction is along the direction in which the pair of side walls 22 face each other, and a shaft 58, which penetrates the upper end portion (the end portion in the direction of arrow C) of the cam portion 56 in its longitudinal direction.

Both axial-direction end portions of the shaft 58 enter engagement holes 60 formed in the pair of side walls 22, and the cam portion 56 is supported on the pair of side walls 22 such that it is pivotable around the axial line of the shaft 58.

A substantially plate-shaped pushed portion 62 is formed on the upper end (opposite from the bottom plate 20 in the direction of arrow C) of the cam portion 56 such that the pushed portion 62 protrudes integrally toward the opposite side of the bottom plate 20 (in the direction of arrow C). The pushed portion 62 corresponds to a later-described release button 70.

A lock surface 56A formed in a circular arc shape coaxial with the shaft 58 is formed on the lower end (bottom plate 20 side in the direction of arrow D) of the cam portion 56. As shown in FIG. 3, the lock surface 56A abuts against the surfaces (in the direction of arrow C) of the abutment tabs 52 of the lock plate 40 in a state where the lock plate 40 has pivoted toward the bottom plate 20 (a state where the insertion plate portion 26 of the tongue plate 24 has been inserted between the pair of side walls 22).

An abutment surface 56B is formed on one thickness-direction end (in the direction of arrow A) of the cam portion 56. As shown in FIG. 4, the abutment surface 56B abuts against the ends of the abutment tabs 52 of the lock plate 40 in a state where the lock plate 40 has separated from the bottom plate 20 (a state where the insertion plate portion 26 of the tongue plate 24 has been removed from between the pair of side walls 22).

A holder 64 is attached to the other thickness-direction end (in the direction of arrow B) of the cam portion 56. A latch protrusion 66 is formed on the holder 64 such that it protrudes toward the opposite side of the cam 56, and one end of a lock spring 68 that is a compression coil spring is latched to the latch protrusion 56. The other end of the lock spring 68 corresponds to the release button 70 disposed on one longitudinal-direction end (in the direction of arrow B) of the buckle body 18.

Figure 1:
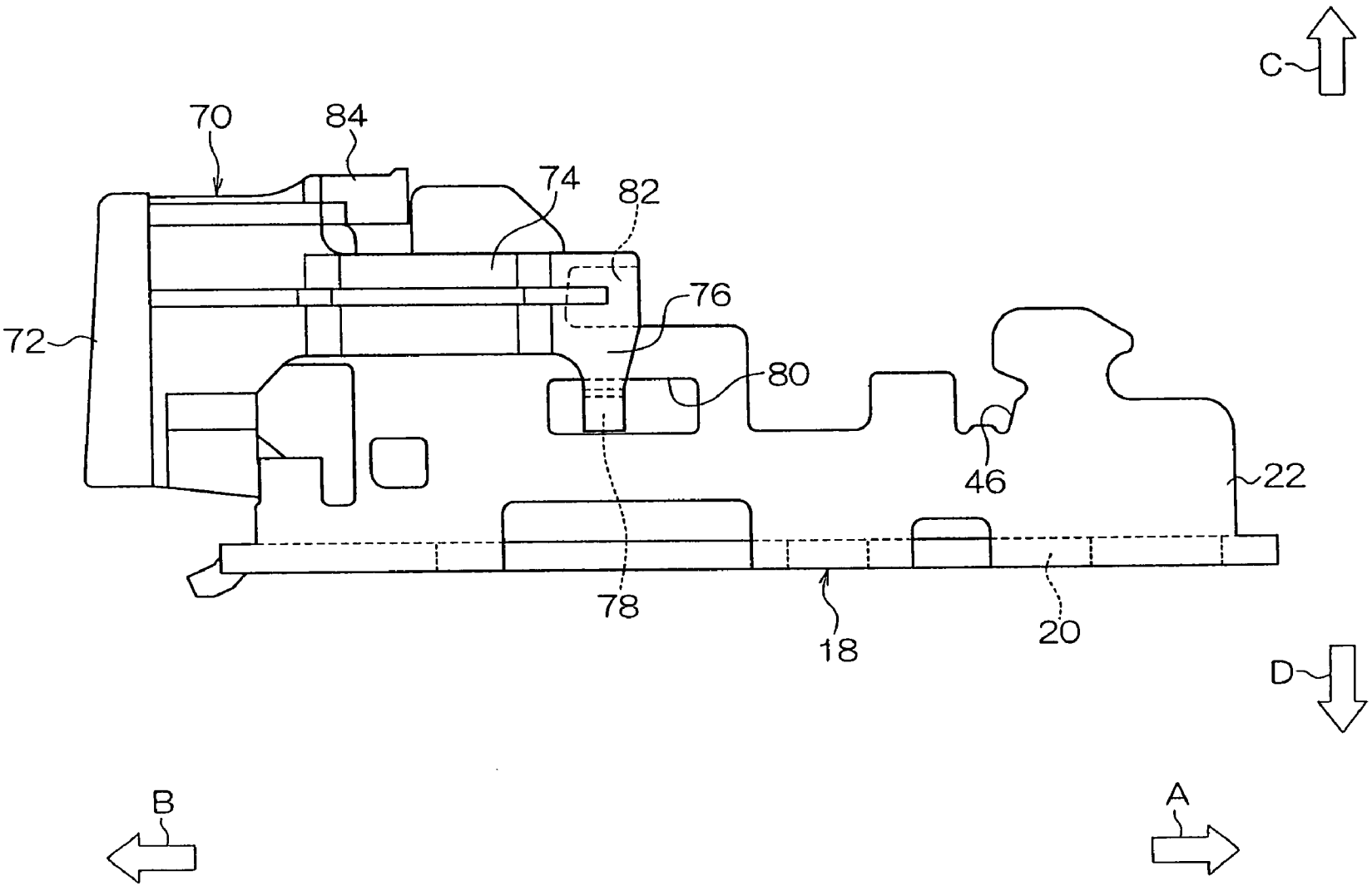
FIG. 1 is a side view showing the configuration of a buckle body and a release button of a buckle device pertaining to an embodiment of the invention.
Figure 2:
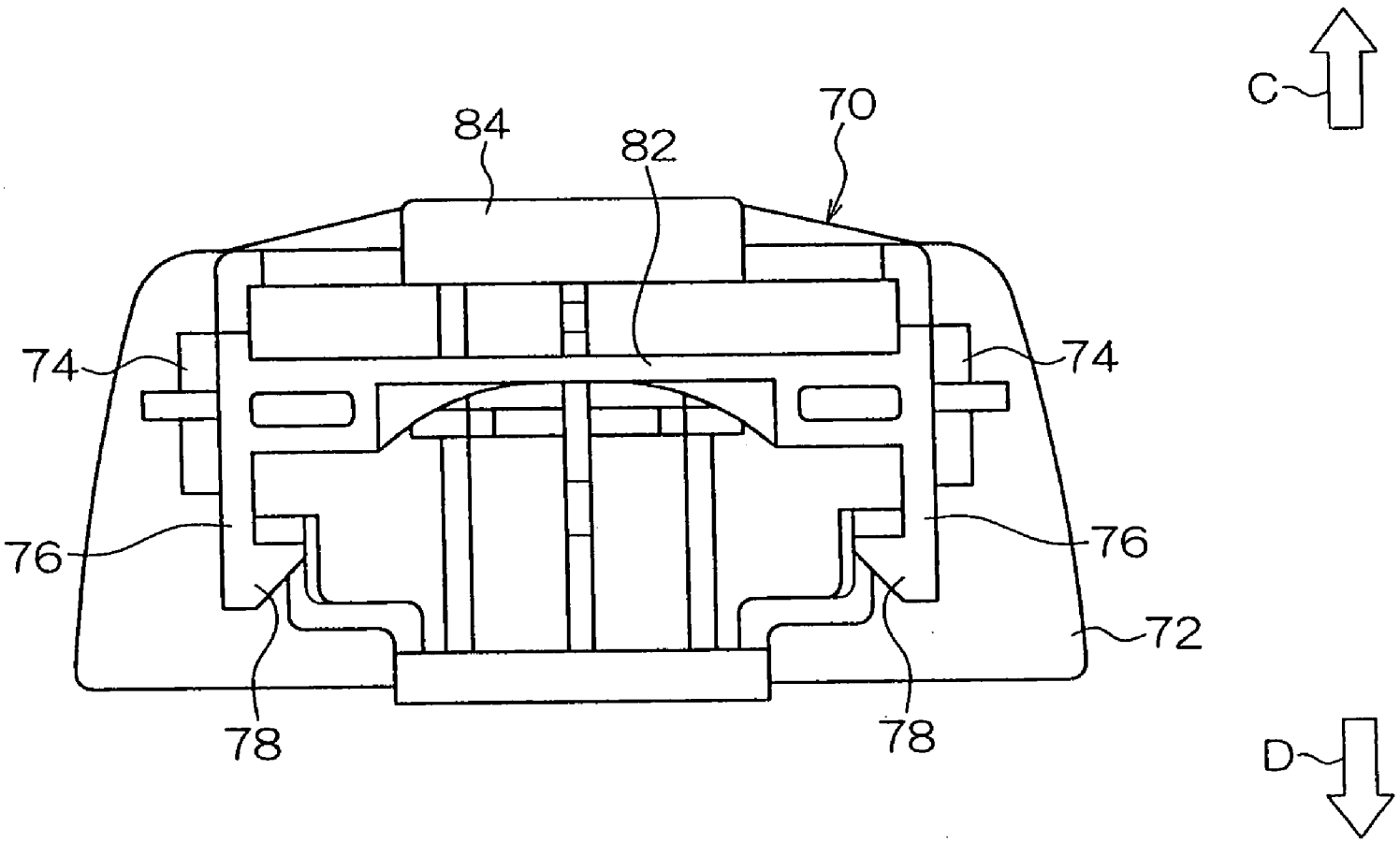
FIG. 2 is a rear view showing the configuration of the release button of the buckle device pertaining to the embodiment of the invention.

The release button 70 is molded using a resin material, and includes an operation portion 72 that is push-operated by a passenger, as shown in FIGS. 1 and 2. The operation portion 72 is formed in a box-like shape that opens toward the other longitudinal-direction end (in the direction of arrow A) of the buckle body 18, and the other end of the lock spring 68 is pressure-welded to the inner bottom wall portion. Thus, the holder 64 and the lock member 54 are urged in the direction in which they separate from the operation portion 72 (in the direction of arrow A).

A pair of arm portions 74 extend from both width-direction ends of the operation portion 72 toward the other longitudinal-direction end of the bottom plate 20 (the insertion direction of the tongue plate 24; the operation direction of the operation portion 72; the direction of arrow A). The pair of arm portions 74 are disposed on the outer sides of the pair of side walls 22 and formed such that they face each other along the direction in which the pair of side walls 22 face each other (in FIGS. 1, 3 and 4, the direction orthogonal to the page surface).

Extension portions 76 extend from the width-direction ends (end portions in the direction of arrow D) of the ends (end portions in the direction of arrow A) of the pair of arm portions 74 toward the bottom plate 20 (in the direction of arrow D). The pair of extension portions 76 have a predetermined elasticity and are formed such that they face each other along the direction in which the pair of side walls 22 face each other.

Pawl portions 78 that protrude toward the side walls 22 (inward in opposing directions) are formed on the ends of the pair of extension portions 76. The pawl portions 78 are formed in thin wedge shapes toward the bottom plate 20 (in the direction of arrow D), and fit into elongated holes 80 formed in the pair of side walls 22. The elongated holes 80 are formed in long shapes along the insertion direction of the tongue plate 24 (in the direction of arrow A). The pawl portions 78 are configured to be movable within a predetermined range along the longitudinal direction of the bottom plate 20 by the inner peripheral portions of the elongated holes 80. Thus, the moving direction (operation direction) of the release button 70 is regulated in the longitudinal direction of the bottom plate 20 by the elongated holes 80.

A coupler portion 82 formed in a long, substantially rod-like shape along the direction in which the ends of the pair of arm portions 74 face each other spans the distance between the pair of arm portions 74. The end portions of the pair of arm portions 74 are coupled together by the coupler portion 82.

A push portion 84 that protrudes toward the other longitudinal-direction end (in the direction of arrow A) of the bottom plate 20 is formed on the upper end (in the direction of arrow C) of the operation portion 72 of the release button 70. The push portion 84 is disposed facing the pushed portion 62 of the lock member 54. When the release button 70 is push-operated, the pushed portion 62 is pushed toward the other longitudinal-direction end (in the direction of arrow A) of the bottom plate 20 by the push portion 84, and the cam portion 56 of the lock member 54 pivots around the shaft 58 toward one longitudinal-direction end (in the direction of arrow B) of the bottom plate 20.

Next, the action of the present embodiment will be described.

In the buckle device 10 with this configuration, when the insertion plate portion 26 of the tongue plate 24 is inserted from the tongue insertion opening 14 in the case 12 in the disengaged state shown in FIG. 4, the end of the insertion plate portion 26 abuts against and pushes the end portion of the ejector 32, as shown in FIG. 3, and the ejector 32 is slid toward the one longitudinal-direction end (in the direction of arrow A) of the through hole 34 counter to the urging force of the ejector spring 38.

When the ejector 32 slides a predetermined amount toward the one longitudinal-direction end of the through hole 34, the state of opposition between the placement surface 32A of the ejector 32 and the engagement tab 50 of the lock plate 40 is released, and the ejector 32 pushes the pair of arm portions 48 of the lock plate 40 and causes the lock plate 40 to pivot toward the bottom plate 20.

Thus, the end portion of the engagement tab 50 approaches and moves toward the bottom plate 20. In this state, the engagement hole 26A in the insertion plate portion 26 and the through hole 34 formed in the bottom plate 20 overlap each other. Thus, in this state, as shown in FIG. 3, the pivoted engagement tab 50 penetrates the engagement hole 26A in the insertion plate portion 26 and the through hole 34 in the bottom plate 20.

When the lock plate 40 pivots, the state of abutment between the abutment tabs 52 of the lock plate 40 and the abutment surface 56B of the lock member 54 is released. Here, because the lock member 54 receives the urging force of the lock spring 68 via the holder 64, the cam portion 56 of the lock member 54 pivots, in conjunction with the pivoting of the lock plate 40, toward the other longitudinal-direction end (in the direction of arrow A) of the bottom plate 20 due to the urging force of the lock spring 68, and the lock surface 56A of the cam portion 56 abuts against the surfaces (the surfaces in the direction of arrow C) of the abutment tabs 52 (the state shown in FIG. 3). For this reason, the pivoting of the lock plate 40 in the direction in which the engagement tab 50 separates from the bottom plate 20 is regulated. Thus, the tongue plate 24 becomes engaged with (retained in) the buckle device 10.

When the operation portion 72 of the release button 70 is push-operated while the tongue plate 24 is engaged with the buckle device 10, the pushed portion 62 of the lock member 54 is pushed toward the other longitudinal-direction end (in the direction of arrow A) of the bottom plate 20 by the push portion 84 of the release button 70, and the cam portion 56 of the lock member 54 is pivoted toward the one longitudinal-direction end (in the direction of arrow B) of the bottom plate 20 counter to the urging force of the lock spring 68.

For this reason, the state of abutment between the lock surface 56A of the cam portion 56 and the abutment tabs 52 of the lock plate 40 is released, and the regulation of the pivoting of the lock plate 40 by the lock member 54 is released. Moreover, a component force in the direction of separation from the bottom plate 20 acts on the engagement tab 50 because the urging force of the ejector spring 38 acts on the engagement tab 50 of the lock plate 40 via the insertion plate portion 26 of the tongue plate 24 and the ejector 32. For this reason, the lock plate 40 is separated from the bottom plate 20 by the component force acting on the engagement tab 50, and the retention of the tongue plate 24 by the engagement tab 50 is released. Thus, the ejector 32 is slid toward the other longitudinal-direction end (in the direction of arrow B) of the through hole 34 by the urging force of the ejector spring 38, and the insertion plate portion 26 of the tongue plate 24 is discharged from the tongue insertion opening 14 in the case 12 by the sliding of the ejector 32.

Here, in the buckle device 10 pertaining to the present embodiment, the release button 70 includes the pair of extension portions 76 that extend from the width-direction ends of the pair of arm portions 74 toward the bottom plate 20 of the buckle body 18. The pair of extension portions 76 have a predetermined elasticity, and the pawl portions 78 formed such that they protrude from the ends of the extension portions 76 toward the side walls 22 of the buckle body 18 movably fit into the elongated holes 80 formed in the side walls 22, whereby the release button 70 is assembled with respect to the buckle body 18.

Thus, when the release button 70 is to be assembled with respect to the buckle body 18, the pawl portions 78 can be fitted into the elongated holes 80 in the buckle body 18 by bending the pair of extension portions 76 and without having to greatly bend the pair of arm portions 74 in the direction in which they separate from each other as in the conventional buckle device. Thus, the release button 70 can be easily assembled with respect to the buckle body 18.

Moreover, the pawl portions 78 of the release button 70 are formed in thin wedge shapes toward the bottom plate 20 of the buckle body 18. Namely, the extension portions 76 and the pawl portions 78 are configured in a so-called "snap-fit" manner, so that when the release button 70 is to be assembled with respect to the buckle body 18, the release button 70 is pushed toward the bottom plate 20 (in the direction of arrow D) from the side of the pair of side walls 22 opposite from the bottom plate 20, whereby a component force in the direction in which the extension portions 76 separate from each other arises in the extension portions 76 due to the sliding contact between the wedge pawl portions 78 and the side walls 22 of the buckle body 18. Thus, the release button 70 can be more easily assembled with respect to the buckle body 18.

Moreover, the ends of the pair of arm portions 74 are coupled together by the coupler portion 82 that spans the distance between them, and the rigidity of the release button 70 is improved by the coupler portion 82. For this reason, even if the push load is biasingly applied to one width-direction end (one of the arm portions 74) of the operation portion 72, deformation of the release button 70 is prevented or suppressed (the alternate deformation of the pair of arm portions 74 along the operation direction is prevented or suppressed). Thus, it is not necessary to set the operation stroke of the release button 70 to be long in consideration of deformation of the release button 70 as in the conventional buckle device. Thus, the device can also be made compact and lightweight.

When the release button 70 is to be assembled with respect to the buckle body 18, the pair of extension portions 76 can be bent by pushing the center portion of the coupler portion 82 toward the bottom plate 20.

As described above, in the buckle device 10 pertaining to the embodiment of the invention, the assemblability of the release button 70 to the buckle body 18 is improved, and deformation of the release button 70 can be prevented or suppressed.

What is claimed is:

1. A buckle device comprising:

a buckle body that includes a bottom plate formed in a long plate-like shape and a pair of side walls extending from both width-direction ends of the bottom plate, with a tongue plate being inserted and retained between the pair of side walls from one longitudinal-direction end of the bottom plate, and with elongated holes along an insertion direction of the tongue plate being formed in the pair of side walls; and a release button that includes an operation portion that is disposed on the one longitudinal-direction end of the buckle body such that it is movable along the insertion direction of the tongue plate and which is push-operated along the insertion direction, and a pair of arm portions that extend from both width-direction ends of the operation portion in the insertion direction, wherein the operation portion is push-operated to release the retention of the tongue plate, and wherein the release button further includes a pair of extension portions that have a predetermined elasticity and extend from respective width-direction ends of the pair of arm portions toward the bottom plate;

pawl portions that protrude from respective ends of the pair of extension portions toward each of the side walls and movably fit into the elongated holes, and a coupler portion that spans the distance between, and couples together, the ends of the pair of arm portions, such that the rigidity of the arm portions is increased and the elasticity of said extension portions is stiffened.

2. The buckle device of claim 1, wherein the pawl portions are formed in thin wedge shapes toward the bottom plate.

3. The buckle device of claim 1, wherein said coupler portion is spaced apart from said operation portion.

4. The buckle device of claim 1, wherein said pawl portions are movably fitted into each of the elongated holes by pressing on the coupler portion toward said bottom plate to bend said extension portions.

5. A buckle device comprising a buckle body, and a release button including an operation portion that is push-operated and a pair of arm portions having elasticity, and ends that terminate in pawl portion, said arm portions extending along an operation direction from both width-direction ends of the operation portion, with the operation portion being push-operated to release the retention of a tongue plate, wherein the release button includes a coupler portion that spans the distance between, and couples together, said ends of the pair of arm portions to stiffen said arm portions such that said pawl portions movably fit into elongated holes of said buckle body more securely.

6. The buckle device of claim 5, wherein said buckle body that includes a bottom plate formed in a long plate-like shape and a pair of side walls extending from both width-direction ends of the bottom plate, with the tongue plate being inserted and retained between the pair of side walls from one longitudinal-direction end of the bottom plate, and with said elongated holes along the operation direction being formed in the pair of side walls, wherein the release button includes a pair of extension portions that have a predetermined elasticity and extend from respective width-direction ends of the pair of arm portions toward the bottom plate, and wherein said pawl portions protrude from respective ends of the pair of extension portions toward each of the side walls and movably fit into the elongated holes.

7. The buckle device of claim 6, wherein the pawl portions are formed in thin wedge shapes toward the bottom plate.

8. The buckle device of claim 5, wherein said pair of arm portions extend in a direction transverse to said insertion direction of said tongue plate.

9. The buckle device of claim 5, wherein said pawl portions are movably fitted into each of the elongated holes by pressing on the coupler portion toward said bottom plate to bend said extension portions.

10. A buckle device comprising:

a buckle body that includes a bottom plate formed in a long plate-like shape and a pair of side walls extending from both width-direction ends of the bottom plate, with a tongue plate being inserted and retained between the pair of side walls from one longitudinal-direction end of the bottom plate, and with elongated holes along an insertion direction of the tongue plate being formed in the pair of side walls; and a release button that includes an operation portion that is disposed on the one longitudinal-direction end of the buckle body such that it is movable along the insertion direction of the tongue plate and which is push-operated along the insertion direction, and a pair of arm portions that extend from both width-direction ends of the operation portion in the insertion direction, wherein the operation portion is push-operated to release the retention of the tongue plate, and wherein the release button further includes a pair of extension portions that have a predetermined elasticity and extend from respective width-direction ends of the pair of arm portions toward the bottom plate, pawl portions that protrude from respective ends of the pair of extension portions toward each of the side walls and movably fit into the elongated holes, and a coupler portion that spans the distance between, and couples together, the ends of the pair of arm portions to stiffen said extension portions of said arm portions such that said movable fit of said pawl portions into said elongated holes is more secure.

11. The buckle device of claim 10, wherein said pawl portions are movably fitted into each of the elongated holes by pressing on the coupler portion toward said bottom plate to bend said extension portions.

12. A buckle device comprising:

a buckle body that includes a bottom plate formed in a long plate-like shape and a pair of side walls extending from both width-direction ends of the bottom plate, with a tongue plate being inserted and retained between the pair of side walls from one longitudinal-direction end of the bottom plate; and a release button that includes an operation portion that is push-operated, with the operation portion being push-operated to release the retention of the tongue plate, wherein the buckle body includes elongated holes formed in the pushing direction in the pair of side walls, wherein the release button further includes a pair of arm portions that extend from both width-direction ends of the operation portion in the pushing direction, a pair of extension portions that have a predetennined elasticity and extend from respective width-direction ends of the pair of arm portions toward the bottom plate, and pawl portions that protrude from respective ends of the pair of extension portions toward each of the side walls and movably fit into the elongated holes, and a coupler portion that spans the distance between, and couples together, the ends of the pan of arm portions to rigidify said extension portions and serve said movable fit of said pawl portions into said elongated holes.

13. The buckle device of claim 12, wherein the pawl portions are formed in thin wedge shapes toward the bottom plate.

14. The buckle device of claim 12, wherein the release button is disposed on one longitudinal-direction end of the buckle body such that it is movable along an insertion direction of the tongue plate, the elongated holes are formed along the insertion direction of the tongue plate, and the operation portion is push-operated along the insertion direction.

15. The buckle device of claim 12, wherein said pawl portions are movably fitted into each of the elongated holes by pressing on the coupler portion toward said bottom plate to bend said extension portions.

* * * * *